US005306083A

United States Patent [19]

Caldwell et al.

[11] Patent Number: 5,306,083

[45] Date of Patent: Apr. 26, 1994

[54] MIXER GUARD MOUNTING MEANS

[75] Inventors: Frank J. Caldwell, West Carrollton; Neal Blackburn, Springfield, both of Ohio

[73] Assignee: Premark FEG Corporation, Troy, Ohio

[21] Appl. No.: 101,868

[22] Filed: Aug. 4, 1993

[51] Int. Cl.[5] ..... B01F 7/16; B01F 7/32; B01F 15/00

[52] U.S. Cl. ..... 366/347; 99/348; 99/645; 126/299 C; 220/369; 366/130

[58] Field of Search ..... 99/348, 645; 366/129, 366/130, 244-251, 261, 331, 347; 126/299 C, 381; 220/369

[56] References Cited

U.S. PATENT DOCUMENTS

| | | | |
|---|---|---|---|
| 1,412,401 | 4/1922 | Gotfredsen | 366/347 |
| 2,051,883 | 8/1936 | Morgan | 366/347 |
| 2,193,356 | 3/1940 | Green | 366/347 |
| 2,607,566 | 8/1952 | Saunders | 99/645 |
| 2,664,169 | 12/1953 | Misener et al. | 99/645 |
| 2,770,389 | 11/1956 | Drakoff | 99/645 |
| 2,790,436 | 4/1957 | Pearcy | 220/369 |
| 3,913,896 | 10/1975 | Hawke | 366/347 |
| 4,549,811 | 10/1985 | Schiffner et al. | 366/331 |
| 4,828,140 | 5/1989 | Henderson | 220/369 |
| 4,900,160 | 2/1990 | Brooks et al. | 366/347 |

*Primary Examiner*—Timothy F. Simone
*Attorney, Agent, or Firm*—Thompson, Hine & Flory

[57] ABSTRACT

A food mixer is provided with a bowl guard consisting of a fixed first semi-cylindrical splash guard portion and a removable semi-cylindrical second see-through portion pivotable about a cylindrical mixer transmission. The second portion is suspended from the transmission by spaced guide shoes mounted on a circumferential ring at the upper end of the pivotable portion. The shoes slidingly engage a fixed track extending horizontally and circumferentially around the transmission portion. The improvement consists of the track being provided as an essentially continuous bead formed in a cylindrical sheet metal band covering the transmission portion. The bead is integral with the band and may be created by rolling or spinning it into the band with metal forming tools. When the second portion of the bowl guard is removed for cleaning away from the mixer, the exterior of the band can be easily cleaned by wiping, since its method of manufacture provides a band surface which is essentially free of food-collecting crevices.

11 Claims, 2 Drawing Sheets

FIG. 5
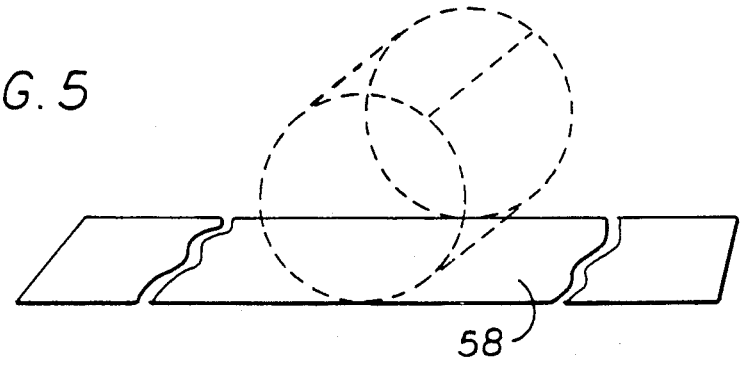
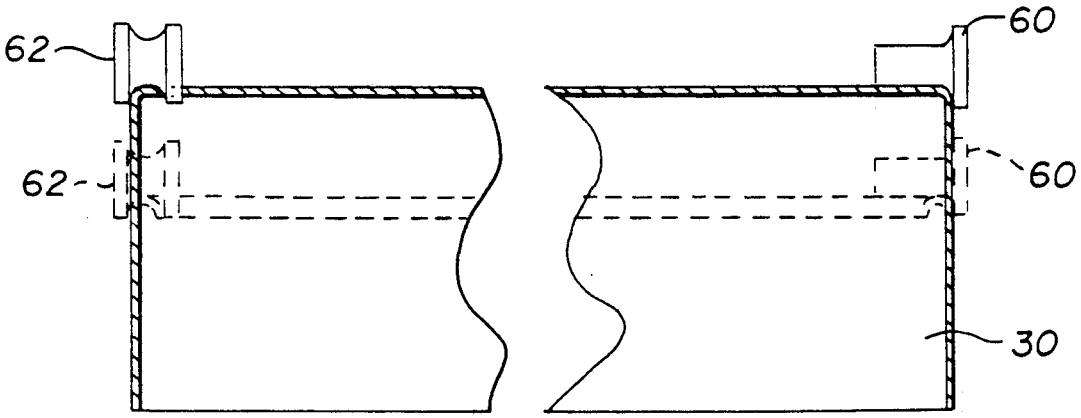
FIG. 6
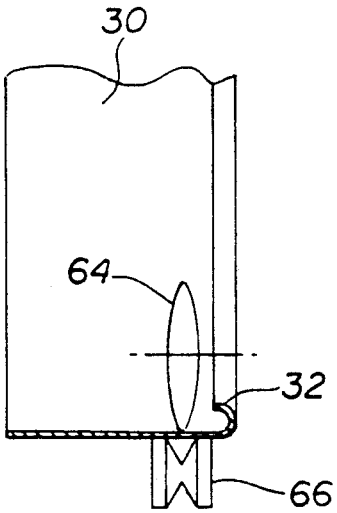
FIG. 7
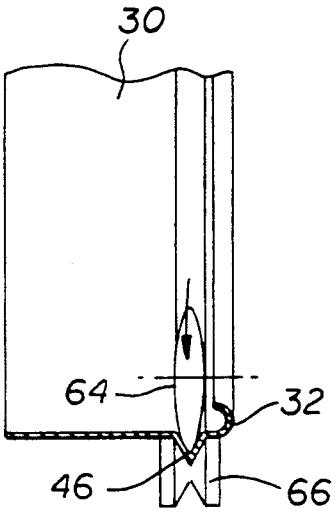
FIG. 8

MIXER GUARD MOUNTING MEANS

This invention relates generally to food mixing machines, and in particular to an easily cleanable guard mounting means located above a mixing bowl in which food ingredients are to be mixed.

BACKGROUND OF THE INVENTION

Manufacturers of food equipment regularly seek to provide devices which limit access by users of the equipment to areas of operating machine elements while the elements are performing food altering or manipulating functions. In so doing, they have often made the equipment more complex. In turn, this design complexity has presented problems of machine cleanliness and loss of productivity during cleaning, particularly where the machines are of a batch-making type and must be cleaned between food batches or when changing batches from one type of food product to another. The more complex and cumbersome the design of guarding, the more difficult it can be to clean and maintain the cleanliness of the machine. This is particularly true where the guarding parts result in crevices being present in areas where food which is splashed, smeared or otherwise distributed collects in such crevices. Oftentimes, the guarding must enable visual inspection of the food during processing. This necessitates that the design be in the nature of a see-through cover which limits physical access to the product while allowing its visual inspection, but enables access when the guarding is removed from a covering position. Frequently, such guarding elements have some parts which are removable to enable their being taken to a sink for scrubbing, hosing or rinsing under a water faucet when cleaning is required. Some such equipment has attaching means for the guarding that is permanently fixed to the machine and therefore the guarding is incapable of being removed for scrubbing at a location remote from the machine. Such parts are often difficult to clean and maintain that way because of the food-collecting crevices which are not easily cleansed on the machine. It is not often that such food machines are used in an environment that allows for them to be hosed down.

One such product, the food mixer, is subject to beating and whipping actions which are capable of causing batter to be splashed about, as much from operator bowl filling and removal operations as from the mixing function itself. When a mixing function has been completed, unless a batch of the same product is to be produced and some carryover is permissible, it is ordinarily necessary to clean the guarding means and surrounding areas. While some parts of a guarding means are typically removable for sink cleaning, other guard-mounting parts remain on the machine and must be wiped clean with a cloth or some other cleaning medium.

SUMMARY OF THE INVENTION

A food mixer is provided with a bowl guard consisting of a fixed first semi-cylindrical splash guard portion and a removable semi-cylindrical second see-through portion pivotable about the vertical axis of a cylindrical mixer transmission. The second portion is suspended from the transmission by spaced guide shoes mounted on an annular ring surrounding the transmission at the upper end of the pivotable portion. The guide shoes slidingly engage a fixed track extending horizontally and circumferentially around the transmission portion.

The improvement consists of the track being provided as an essentially continuous bead formed in a cylindrical sheet metal band covering the transmission portion. The bead is integral with the band and may be created by rolling it into the band with forming tools. When the second portion of the bowl guard is removed for cleaning away from the mixer, the exterior of the band can be easily cleaned by wiping with a cloth, since its method of manufacture provides a band surface which is essentially free of food-collecting crevices.

It is a principal object of the invention to provide a fixed mounting means for a bowl-guarding system of a food mixing machine, which fixed means is easily cleanable by wiping when the guarding system has been removed from the machine.

Another object is to eliminate the several individually-mounted elements of known mixer guard mounting means and replace them with a simple and relatively inexpensive modification to an already-existing part of a standard food mixer.

A further object is to suspend a removable portion of the guarding system from a horizontal circumferential track means on the outer periphery of a mixer transmission by three essentially equidistantly-spaced guide shoes, and to enable one of said shoes to allow for the removable portion to be dropped below the transmission and removed from the mixer.

Other objects will become apparent from the following description, in which reference is made to the accompanying drawings.

BRIEF DESCRIPTION OF THE DRAWINGS

FIGS. 5 through 8 show successive steps followed in one method of producing the guard-mounting band of FIG. 3.

DETAILED DESCRIPTION OF THE PREFERRED EMBODIMENT

Figure 1:
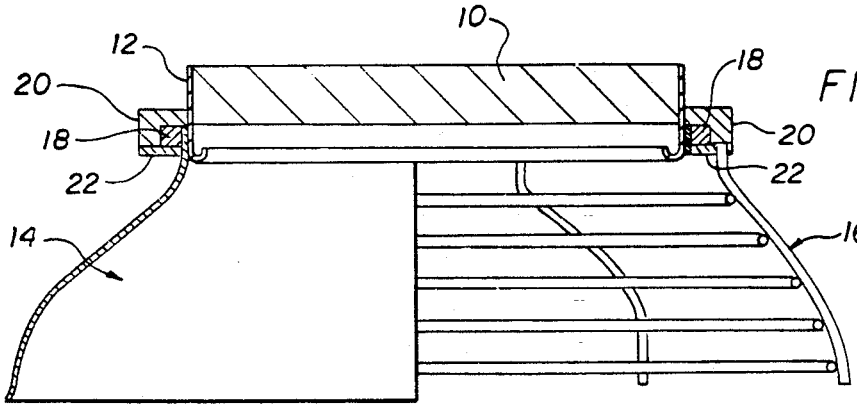
FIG. 1 PRIOR ART
FIG. 1 is a fragmentary side-elevational view of a prior art mixer guard and its mounting means.

The Prior Art design illustrated in FIG. 1 is taken from European Patent Application 0 512 172 A1. It is typically suspended downwardly from a cantilevered mixing head mounted on a vertical mixer body, neither of which is shown herein because of the common nature of food mixers with which the structure of FIG. 1 is used. Using the nomenclature of the '172 European Application, a central housing 10 contains gearing of a planetary transmission for moving a beater in rotary and orbital fashion inside a bowl to mix batter contained in the bowl. The transmission is typically cylindrical and the housing 10 thereof includes an annular sheet metal band 12. Until recent times, with the usual mixer of this type (which has been the standard for over 50 years), the band 12 has had nothing covering it and was easily cleanable by cloth wiping.

Figure 2:
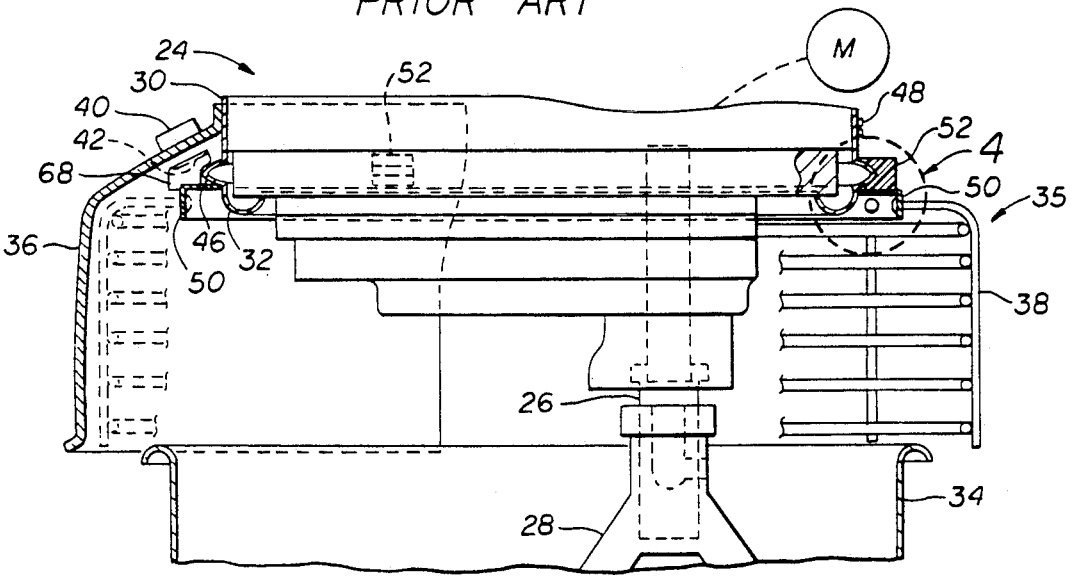
FIG. 2 illustrates the improved mixer guard mounting means for direct comparison with the mounting means of the prior art FIG. 1 device.

The addition of a guarding means such as shown in FIG. 1 is of relatively recent origin, since such machines are ordinarily easy and safe to operate if proper operator attention is paid to the job while the machine is running and if proper respect is given by the operator to moving parts. However, owners of such equipment have found that operator safety rules are not always heeded, even where proper training is provided and an operator manual is supplied with each machine to instruct the operator in its proper use. The design of FIG. 1 provides a "fixed part, rear half guard assembly" 14 and a "rotatable part, front half guard assembly" 16, which, together comprise the bowl guard suspended from the transmission central housing 10. In terms of operator location, the operator station is at the right of FIG. 1 and the body of the mixer is at the left. The rear half 14 prevents in large measure any splashing of batter and dry ingredients onto the mixer body and surrounding housings. The front half 16 is essentially nested with the rear half 14 during filling of a bowl positioned below the guarding system (as is seen in FIG. 2), by having been rotated 180 degrees from the position of FIG. 1 to become adjacent the rear half 14. After filling and in preparation for mixing, the front half 16 is returned to the full line position of FIG. 1. The mixer can then be run for the necessary time period to mix the batch. Ingredients in liquid, powder or granular form can be added to the batch if required, by passage through the wire grill of front half 16.

A deficiency of the design of the guarding system of FIG. 1 is that the manner of supporting the assemblies 14 and 16 consists of elements which are difficult and time-consuming to clean between batches, at least relative to the design of our invention. A "fixing device" 18 encircles and is attached to the band 12. Whether the fixing device 18 is one piece (or multiple pieces as in the commercial version of the product of FIG. 1), the riveting or screwing of separate parts which make up the fixing device 18 inherently creates crevices between the device 18 and the band 12. Such crevices are undesirable and objectionable in food handling equipment from the sanitation standpoint. They either require more time than should be necessary to clean the equipment properly, or else they are not cleaned as well as they should be.

A circumferentially-extending "retaining ring" 20 is mounted on the upper end of the front half 16 of the guard assembly. It appears from the aforementioned European patent application of the FIG. 1 device that the ring 20 is of single annular casting which is an inverted L-shape in cross-section. In conjunction with another flat ring 22 attached to the underside of the ring 20, the retaining ring 20 encompasses three sides of the fixing device 18, and becomes a unitary guide member which is rotatably supported for horizontal movement about the track formed by the fixing device on band 12. In the known commercial version of the FIG. 1 system, the fixing device 18 consists of a plurality of separate segments or parts, and the rings 20 and 22 consist of a pair of hinged C-shaped guides which ride on and over the fixing devices 18. By virtue of the hinging, the rotatable fronthalf 16 can be removed from the mixer and taken to a remote location for cleaning. The separate parts of the track making up the fixing device 18 remain with the mixer, however, and must be wiped by a cloth to be cleaned. The shape and mounting of the separate parts does not provide for easily-cleanable and smooth contours such as in the design of our invention, which will now be described in conjunction with FIG. 2 and the remaining Figures.

The structure shown in FIG. 2 includes the main elements of a mixer such as that described in relation to FIG. 1. The mixer would include a body and head (neither of which is illustrated) supporting a cylindrical transmission portion 24 of which only a ring gear is shown. The transmission includes conventional planetary gearing causing both rotary and orbital motion of a mixing shaft 26. One of several different kinds of mixing implements is mounted with a customary bayonet type of connector to the lower end of the shaft 26. The upper end of a beater 28 is seen. A cylindrical band 30 preferably made of stainless sheet steel surrounds the outer periphery of the transmission portion 24. Band 30 is usually called a drip cup in the food equipment trade. The band or drip cup 30 has the customary upturned lip or cup 32 at its lower end to prevent any possible leakage of transmission fluid into a batter in a bowl 34. All of the above-described elements described in connection with FIG. 2 are standard on most food mixers of this type and are mentioned only as background to better understand the improvement of our invention. Supported on the band 30 on the side of the transmission 24 adjacent the body of the mixer is a fixed half of a bowl guard 35. The fixed half consists of a semi-cylindrical splash guard 36. The guard 36 forms a skirt between the top of the bowl and the transmission, and encompasses approximately one-half of the open bowl top. The splash guard 36 is preferably of polished sheet stainless steel and is spot-welded to the band 30. The guard 36 is configured to have smooth and radiused curves to enable ease of wiping clean upon job completion or changing of materials being mixed. To that extent, it is similar in construction and purpose to the rear half guard assembly 14 of the prior art construction of FIG. 1. Additionally, a structure substantially similar in function and construction to the front half guard assembly 16 of FIG. 1 is designated a removable semi-cylindrical see-through guard portion 38 in FIG. 2. It is preferably formed of rods or wires into cage-like structure extending downwardly from the transmission portion 24 to closely adjacent the top of the bowl 34, and will be referred to at times as the wire cage assembly 38. The assembly 38 is pivotable between the solid-line position of FIG. 2 to a nested position relative to the splash guard 36, as illustrated at the left in dotted lines. The former full-line position is referred to hereinafter as the bowl-covering position and the latter dotted-line position is called the bowl-access position. These terms describe the ability of the operator to gain access to an uncovered bowl or be prevented from gaining access except by something smaller than the space between the rods that make up the wire cage assembly 38. The assembly 38 may also be made of a window type material such as clear plastic, but that effectively prevents the addition of extra dry or liquid ingredients to the bowl while the mixer is operating. Additionally, a plastic enclosure inhibits escape of heat and moisture from the mixing batter. For some products, that escape is essential. Furthermore, collection of moisture on the inside of such an enclosure would likely prevent observation of the product during mixing. As also mentioned in connection with the prior art European Patent Application, a mixer motor M has wired in series therewith a normally-open reed-type proximity switch 40 which is closed only when a magnet 42 is in its position shown in FIG. 2. Magnet 42 is mounted to move with the wire cage assembly 38, so that if it is pivoted about a vertical axis out of its full-line position of FIG. 2, the circuit to the motor is immediately disconnected and the motor comes to a stop. The motor remains disabled until the cage assembly 38 is returned to its full line or bowl-covering position. Latch means (not shown) maintains the cage assembly 38 in its bowl-covering position and is designed to require physical unlatching in order to move the guard portion either to the left or right toward the bowl-access position.

The improvement of this invention resides in the construction of the drip cup or band 30 and in the second pivotable wire cage assembly 38 which enables it to be easily removed from the mixer for sink cleaning. Because of the inherent volume of crevices at the rod-connecting joints of wire cage assembly 38, which joints are capable of collecting food splashed from the bowl, sink cleaning of portion 38 is essential. There the assembly can be hosed down, scrubbed or otherwise cleaned between mixing jobs. The remaining parts of the bowl guard 35 remain fixed on the machine, however, and are ordinarily wiped clean with a cloth. This requires frequent changing or rinsing of cleaning cloths depending on the amount of material splashed on the fixed parts of the guarding system.

The band 30 which contains the drip cup 32 at its lower end is also provided with a guide track means in the form of a bead 46 which is ordinarily rolled into the sheet metal band after creation of the cup 32. The general method of construction of the bead 46 in band 30 will be discussed in connection with FIGS. 5–8. The bead 46 extends circumferentially and horizontally entirely around the band 30. Band 30 is fixed to the housing of transmission 24 by means of screws 48, only one of which is shown. As will be seen, whenever the wire cage assembly 38 has been removed from the mixer, the outer surface of the band presents an easily wipable surface since it contains none of the food-collecting crevices found in prior art mixers. Band 30 is shown by itself in FIG. 3 prior to installation on the mixer during factory assembly. The relatively smooth radiused curves of the bead allow the ease with which the band may be cleaned. One can imagine what it would be like to have to clean six or more prior art track segments which are riveted to the outer surface of the conventional band of the FIG. 1 device and which lack the smooth radiused surfaces. In addition to its cleanability, the sheet metal construction of the band makes it considerably less expensive to produce than the corresponding structure of the FIG. 1 guarding system.

Figure 4:
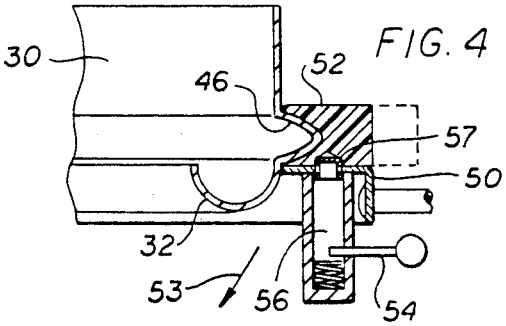
FIG. 4 is an enlarged view of the elements within circle 4 of FIG. 2, with additional parts also being shown to enable an understanding of one form of operation of the retract-ability and locking functions.
Figure 3:
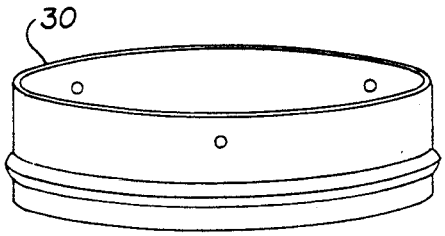
FIG. 3 is a key element of the improved guard-mounting means embodied in the design of FIG. 2, modified from the prior art by the addition of a bead formed about the periphery thereof.

The removable wire cage assembly 38 has an annular ring 50, a small segment of which is shown in the enlarged view of FIG. 3. The ends of vertical rods of assembly 38 are joined to a vertically depending flange of the ring 50. A horizontal portion of the ring 50 supports three guide shoes 52 which are horizontally and circumferentially spaced approximately 120 degrees apart. The shoes 52 are made of a relatively friction-free plastic material so as to enable easy pivotable movement of the assembly 38 about the bead 46 with which grooves in the shoes cooperate. Two of the shoes 52 remote from the operator station are fixed to the ring, while the shoe 52 at the operator station at the right of FIG. 2 is radially movable relative to the transmission between the full and dotted lines positions of FIG. 4. Alternatively, instead of the shoe being radially movable, its upper section can be made to move away from the bead to allow the assembly to be lowered for removal. In the form illustrated, with the groove of the movable shoe being in contact with the bead, the shoe can be moved by manual means (not shown) of any type to enable that end of assembly 38 to pivot and move downwardly about the other two shoes 52 in the direction of arrow 53. Once it has dropped below the bead and while still holding the assembly 38, the assembly 38 can be moved slightly toward splash guard 36 to have the grooves in the other two shoes 52 detach from the bead 46. Upon detachment, the whole wire cage assembly 38 can be lowered and taken to a remote location for cleaning. Ordinarily, before removal, the bowl 34 would have been lowered below its mixing position and the beater 28 would be removed from shaft 26. The beater 28 and guard portion 38 can then be taken together to a sink. Before the movable shoe 52 is moved to its dotted line position, a ball and detent or other type of latching means of any kind must be operated to enable removal. The means depicted in FIG. 4 is simply shown as a handle 54 which is pushed downwardly to cause a spring-loaded plunger 56 to retract from a hole 57 in the bottom of the movable shoe 52. The movable shoe is restrained in a radial guideway (not shown) which enables the ends of travel of the movable shoe only between the limits shown by the full and dotted line positions of the movable shoe. The guideway is not shown for purposes of clarity, but obviously the construction of the guideway is well within the skill of the ordinary mechanical designer.

The improved band 30 may be produced according to the method described in connection with FIGS. 5–8. FIG. 5 simply shows how a rectangular flat sheet of stainless steel 58 is taken from its flat condition shown in full lines to a cylindrical shape illustrated in dotted lines. This is done by rolling it about a cylindrical body. Once cylindrical, its ends are butted and welded at the butt seam. After grinding the weld flush and truing the cylinder, the piece that is to become the band 30 is placed in a machine to form the lip or cup 32 in known fashion, with quarter-round and half-round rolls 60 and 62 respectively, as shown in FIG. 6.

FIGS. 7 and 8 illustrate the forming of the bead 46. This is accomplished with a mating pair of rolls 64 and 66. The bead 46 is formed as close to the cup 32 as possible to enable the overall guard-mounting design to be kept compact. At the left of FIG. 2, for example, not much space exists between the bead 46 and the splash guard 36. This space is almost fully occupied in an essentially-radial direction by the shoes 52 and a retainer 68 for the magnet 42, all of which are carried on the annular ring 50. Whether it would be feasible to form the bead 46 so close to the drip cup 32 was not known at the time the design was conceived. The design required that closeness, however, since it was necessary to continue using a drip cup as an essential part of a mixer which is suspended over a bowl.

While we have illustrated rolling tools for forming the bead 46 in the band 30, other techniques may be utilized to create a smooth, radiused outer bead without crevices, around essentially 360 degrees of the band 30. Metal spinning would be an acceptable alternative. Further, while we specify 360 degrees circumferential extension of the band 30, we recognize that a vertical slot or hole can be created in the band 30 at the point adjacent the movable shoe 52 when the magnet is positioned in the proximity of switch 40. This slot or hole, while presenting a single crevice in the band, would serve to lock the wire cage assembly 38 in the bowl-covering position while the mixer is operating. A single slot or hole located at a most accessible front part of the band 30 presents no real cleaning difficulty such as is present in the prior art design where difficult-to-clean parts require twisting and turning one's body to see and perform the cleaning function.

Having described our invention, we claim:

1. In a food mixer having an electric motor; a power transmission driven thereby and having an essentially cylindrical portion with a rotary mixing shaft extending downwardly therefrom; said shaft having means for receiving a mixing member on its lower end for rotation with said shaft to mix food ingredients in an open-topped bowl positioned therebelow; a bowl guard suspended from said cylindrical transmission portion and covering the open top of said bowl while said mixing shaft is rotating, said guard comprising a fixed first essentially semi-cylindrical splash guard portion remote from an operator station and a second removable semi-cylindrical see-through portion adjacent said operator station; said second portion being pivotable about a vertical axis centrally of said transmission cylindrical portion between a bowl-covering position encompassing that area of the open top of the bowl not covered by said splash guard portion and a bowl-access position in which said first and second portions are adjacent and essentially nested; a plurality of circumferentially-spaced inwardly-facing guide shoes on said second portion adjacent said cylindrical transmission portion for enabling pivoting of said second see-through portion about said transmission; and fixed track means associated with said cylindrical transmission portion for slidably receiving said guide shoes; the improvement comprising:

said track means consisting of a cylindrical sheet metal band surrounding and coaxially-fixed to a lower end of said cylindrical transmission portion, said band having an outwardly-directed horizontal bead integral therewith and extending essentially 360 degrees thereabout for supporting said pivotable portion by means of said guide shoes for enabling pivotal movement thereof between its bowl-covering and bowl-access positions, said bead and the adjacent outer surface of said band being essentially free of food-collecting crevices whereby, upon removal of said second portion for cleaning away from said mixer, the outer surface of said band and bead can be completely and easily wiped free of food splashed thereon during mixing.

2. The invention according to claim 1 wherein said second portion of said bowl guard comprises a wire cage assembly extending circumferentially and radially with respect to said cylindrical transmission portion.

3. The invention according to claim 1 wherein said bead is formed into said band by metal working tools and is of the same thickness as the remainder of said sheet metal band.

4. The invention according to claim 3 wherein said band and bead are produced by the process of providing a flat sheet of metal of a length equal to the end circumference of the band and of a width equal to the end height of said band, forming the sheet into a cylinder by butt-welding the lengthwise ends of the sheet together, providing a male rotary tool on the inside of said cylinder and a cooperating female rotary tool on the outside of said cylinder, said tools and said cylinder being on parallel axes, and contacting said tools and said cylinder while relatively rotating said cylinder with respect to said tools to roll said outwardly-directed bead.

5. The invention according to claim 4 wherein a second set of cooperating forming tools is provided and wherein there is also rolled in the end of said band nearest said bowl by said second set of forming tools an inwardly and upwardly turned lip providing a cup for retaining any potential leakage of oil from said transmission into said bowl.

6. The invention according to claim 5 wherein said bead and said cup are closely positioned relative to each other at the lowermost end of said band when the band is in position on said cylindrical transmission portion.

7. The invention according to claim 1 wherein said bead extends essentially 360 degrees about said band.

8. The invention according to claim 1 wherein said second see-through portion of said bowl guard includes a ring for supporting said guide shoes and suspending the second removable portion of said bowl guard therefrom, said shoes being three in number and essentially equally spaced 120 degrees about said ring, and wherein at least a portion of one of said guide shoes is retractable relative to said bead whereby said ring and second pivotable portion may be lowered, removed from said bead and cleaned at a location remote from the food mixer.

9. The invention according to claim 8 wherein said one guide shoe is mounted for outward movement relative to said ring between a first position in which said one shoe is slidably supported about said bead and a second position in which said one shoe clears at least the upper portion of said bead to enable the second pivotable portion to be lowered for removal.

10. The invention according to claim 9 wherein means is provided to maintain said one shoe in said first position when said second pivotable portion is mounted on said food mixer for movement between said bowl-covering position and said bowl-access positions.

11. The invention according to claim 10 wherein said means to maintain said one shoe in said first position comprises a two-part latch and detent means, one part on said ring and the other part on said one shoe.

* * * * *